US009728349B2

(12) United States Patent
Huang et al.

(10) Patent No.: US 9,728,349 B2
(45) Date of Patent: Aug. 8, 2017

(54) BUTTON STRUTURE AND ELECTRONIC DEVICE WITH SAME

(71) Applicant: Chiun Mai Communication Systems, Inc., New Taipei (TW)

(72) Inventors: Yu-Wei Huang, New Taipei (TW); Kao-Kuan Su, New Taipei (TW); Min-Sheng Wang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 14/954,997

(22) Filed: Nov. 30, 2015

(65) Prior Publication Data

US 2017/0025234 A1 Jan. 26, 2017

(30) Foreign Application Priority Data

Jul. 22, 2015 (CN) ..... 2015 1 0433134

(51) Int. Cl.
*H01H 13/703* (2006.01)
*H01H 13/02* (2006.01)
*H01H 13/83* (2006.01)

(52) U.S. Cl.
CPC ..... *H01H 13/023* (2013.01); *H01H 13/83* (2013.01); *H01H 13/703* (2013.01); *H01H 2219/044* (2013.01); *H01H 2219/06* (2013.01); *H01H 2219/062* (2013.01); *H01H 2219/064* (2013.01); *H01H 2219/066* (2013.01); *H01H 2219/0622* (2013.01)

(58) Field of Classification Search
CPC ..... H01H 13/023; H01H 21/025; H01H 2013/026; H01H 2219/014; H01H 13/702; H01H 2219/056; H01H 2219/062; H01H 2219/044; H01H 2219/064; H01H 2219/066
USPC ..... 200/310–317
See application file for complete search history.

(56) References Cited

U.S. PATENT DOCUMENTS 7,253,369 B2 * 8/2007 Fu ..... H01H 13/83 200/310
2004/0134765 A1 * 7/2004 Sotome ..... H01H 13/023 200/521
2014/0332360 A1 * 11/2014 Touchette ..... H01H 13/023 200/5 A

FOREIGN PATENT DOCUMENTS

CN 203367068 U 12/2013
CN 204187535 U 3/2015
TW M397601 U1 2/2011

* cited by examiner

*Primary Examiner* — Edwin A. Leon
*Assistant Examiner* — Ahmed Saeed
(74) *Attorney, Agent, or Firm* — Steven Reiss

(57) ABSTRACT

A button structure includes a circuit board, a switch module, a light source module, and a button body. The button body includes a substantially cylindrical shaped light guide member and a pressing member. The light guide member includes a periphery wall having at least one light guide surface. The pressing member is movably mounted in the light guide member and faces the switch module. When the pressing member is pressed, the pressing member activates the switch module and the switch module is activated to control the light source module to irradiate light, so that the light from the light source module enters the light guide member through the at least one light guide surface and is emitted out from a top portion of the periphery wall.

22 Claims, 8 Drawing Sheets

BUTTON STRUTURE AND ELECTRONIC DEVICE WITH SAME

FIELD

The subject matter herein generally relates to a button structure and an electronic device with the same

BACKGROUND

Most of electronic devices, such as mobile phones or personal digital assistants (PDAs), commonly include buttons for functional controlling, such as, power switch button, volume controlling button, screen locking button, or camera switch button. In addition, the buttons are generally combined with light sources, such as light emitting diodes, to improve attractiveness. However, the light sources are generally located below the buttons, due to different distances between the light sources and a surface of the button and an uneven reflection, light transported to the surface of the button is uneven, which leads to a bad effect.

BRIEF DESCRIPTION OF THE DRAWINGS

Implementations of the present technology will now be described, by way of example only, with reference to the attached figures.

DETAILED DESCRIPTION

Figure 1:
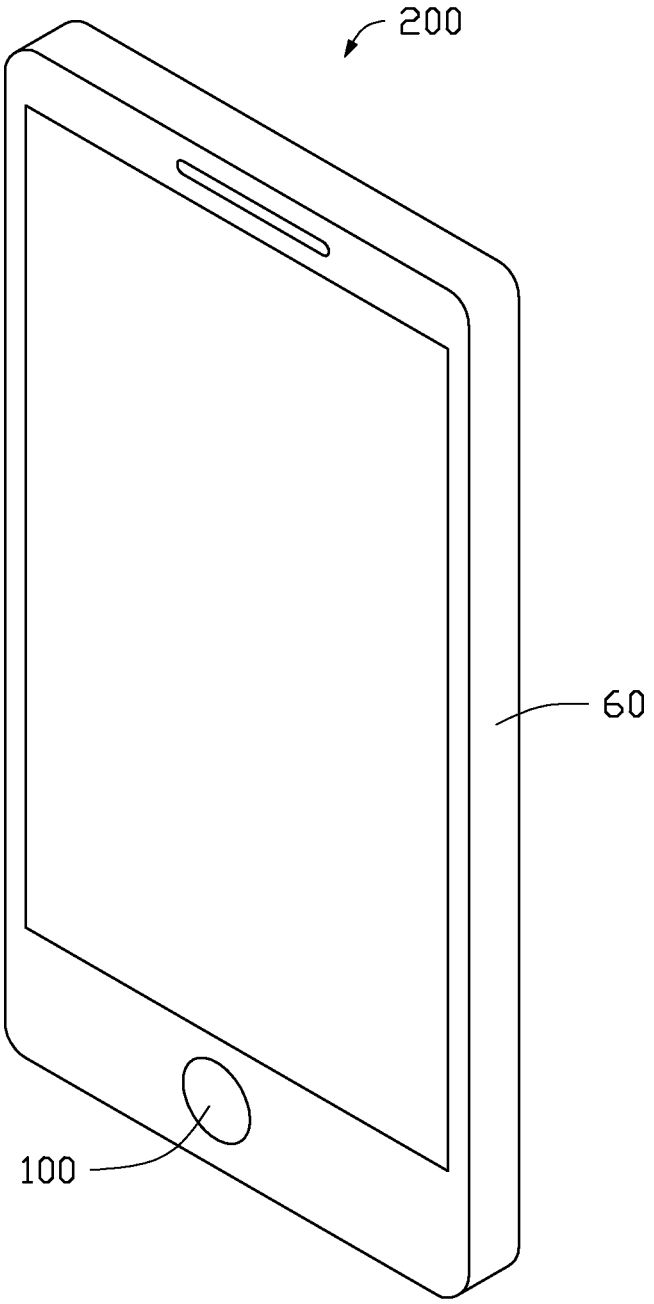
FIG. 1 is an isometric view of a first embodiment of a button structure applied to an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to", it specifically indicates open-ended inclusion or membership in the so-described combination, group, series and the like.

Figure 2:
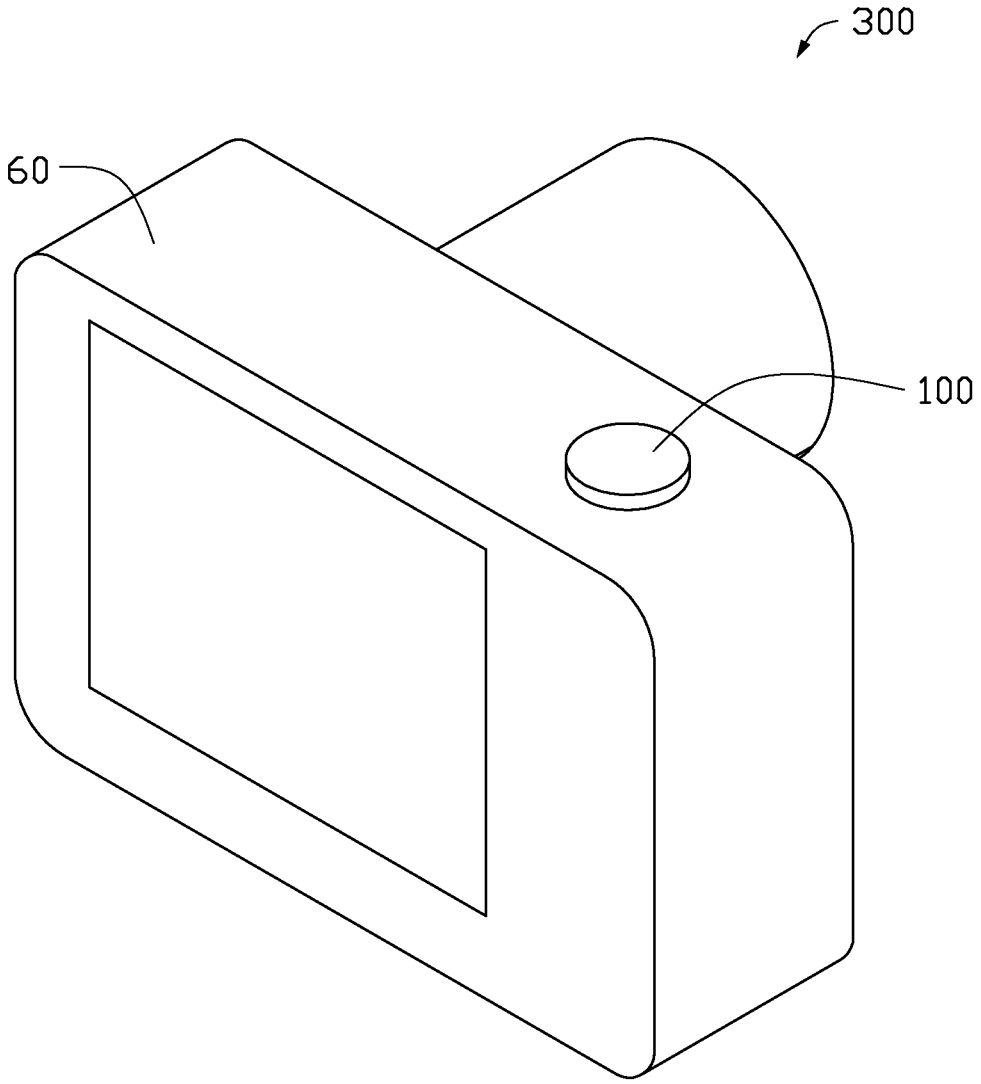
FIG. 2 is an isometric view similar to FIG. 1, but showing the button structure applied to another electronic device.

FIG. 1 illustrates a first embodiment of a button structure 100 applied to an electronic device which have buttons, for example, a mobile phone 200. FIG. 2 illustrates the button structure 100 applied to a digital camera 300. The electronic device includes a housing 60 and the button structure 100 is positioned in and partly exposed from the housing 60. The button structure 100 is configured for functional controlling, such as power switch button, volume controlling button, or screen locking button.

Figure 3:
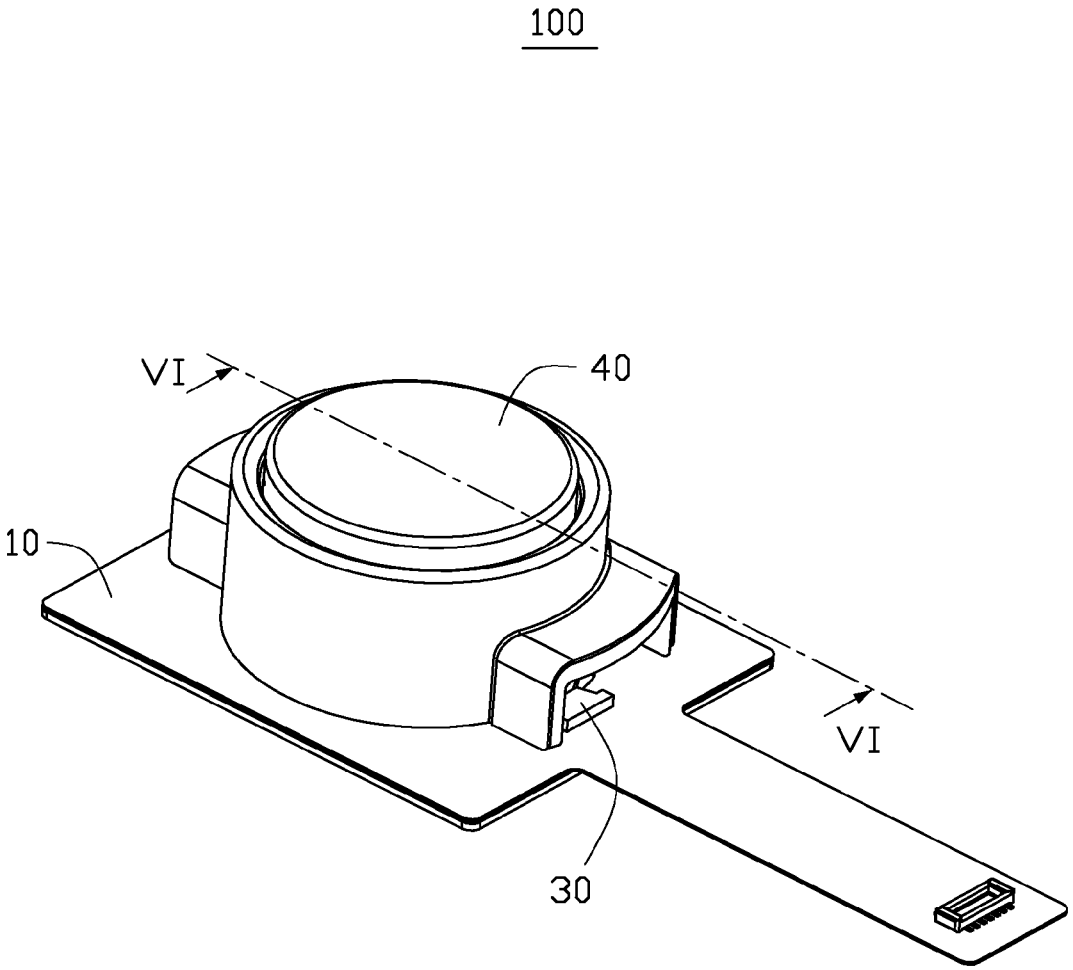
FIG. 3 is an isometric view of the button structure of FIG. 1.

FIG. 3 illustrates that the button structure 100 includes a circuit board 10, a switch module 20 (shown in FIG. 4), a light source module 30, and a button body 40. In at least one embodiment, the circuit board 10 is a flexible circuit board. The switch module 20, the light source module 30, and the button body 40 are all mounted on the circuit board 10.

Figure 4:
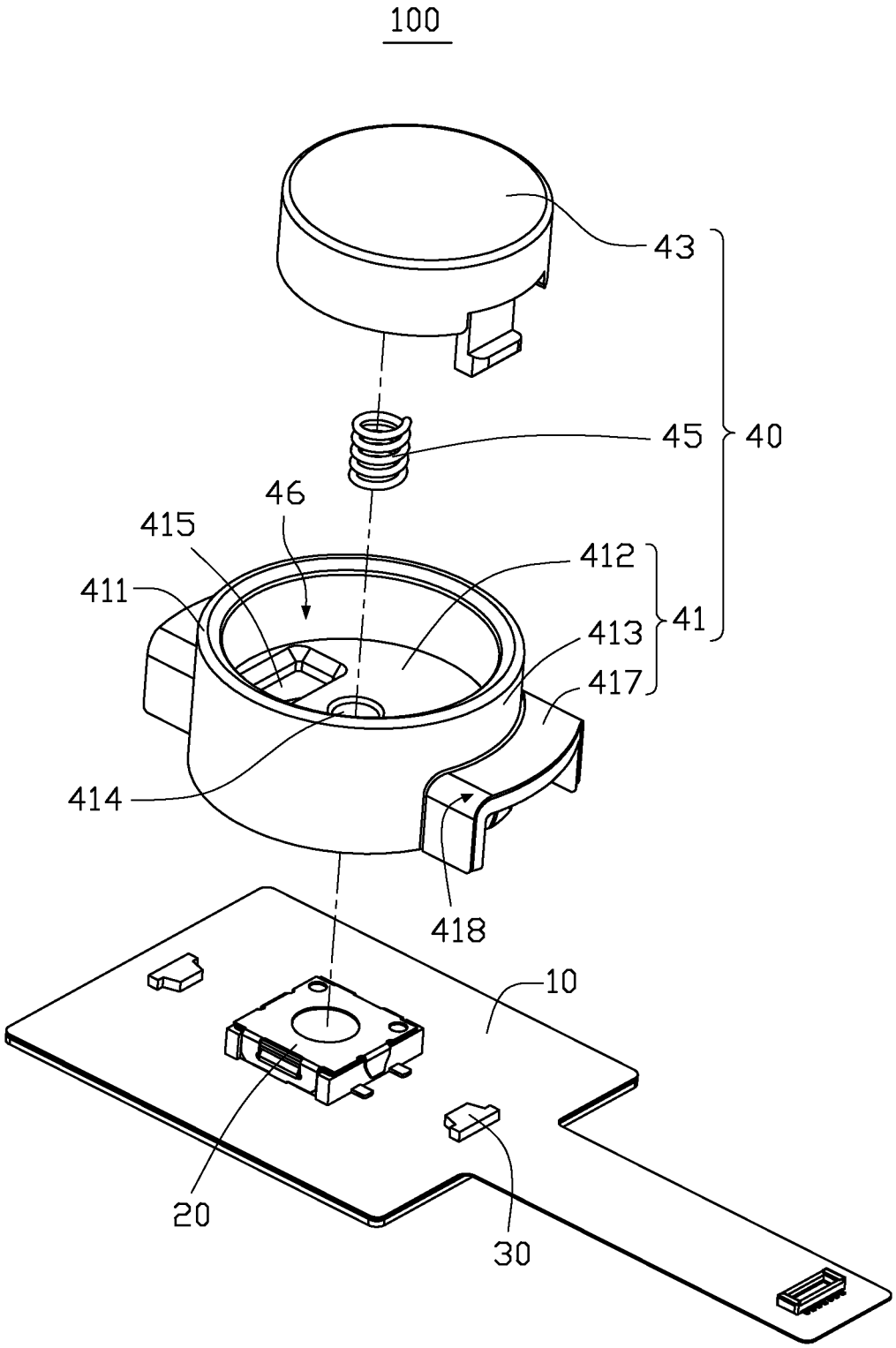
FIG. 4 is an exploded, isometric view of the button structure of FIG. 3.

FIG. 4 illustrates that the switch module 20 is located on the middle of the circuit board 10. When the switch module 20 is activated (for example, be pressed), the switch module 20 controls the light source module 30 to irradiate light.

The light source module 30 includes at least one group of light-emitting units. Each group of light-emitting units includes at least one light-emitting element. In at least one embodiment, the light source module 30 includes one group of light-emitting units. The group of light-emitting units includes two light-emitting elements. The light-emitting elements can be light emitting diodes (LEDs). In at least one embodiment, the two light-emitting elements are white LEDs and are positioned at two sides of the switch module 20.

The button body 40 is positioned above the switch module 20 and the light source module 30. The button body 40 includes a light guide member 41, a pressing member 43, and an elastic member 45.

The light guide member 41 is made of transparent or translucent material and is substantially a cylinder. The light guide member 41 includes a bottom wall 412 and a periphery wall 413. The bottom wall 412 is substantially circular. The periphery wall 413 is substantially a hollow ring-shaped cylinder. The periphery wall 413 is positioned at a periphery of the bottom wall 412 and includes a ring-shaped top portion 411. The periphery wall 413 and the bottom wall 412 cooperatively form a first receiving cavity 46 and a second receiving cavity 47 (shown in FIG. 5) which are positioned at two sides of the bottom wall 412.

The bottom wall 412 further defines a through hole 414 and two latching slots 415 positioned at two sides of the through hole 414. An outer surface of the periphery wall 413 forms at least one light guide surface 416 (shown in FIG. 5). The light guide surface 416 can be a concave surface, or preferably, be an arc surface. The light guide surface 416 is configured to guide the light from the light source module 30 to the periphery wall 413 of the light guiding member 41, then the light can be transported out from the top portion 411 of the periphery wall 413. Due to the light guiding surface 416 is an arc surface, the light from the light source module 30 can be evenly guided to the periphery wall 413 through the light guide surface 416, thereby being evenly transported to the top portion 411 of the periphery wall 413. In at least one embodiment, the outer surface of the periphery wall 413 forms two light guide surfaces 416 corresponding to the two LEDs. Each light guide surface 416 is positioned adjacent to one latching slot 415.

As illustrated, the light guide member 41 further includes at least one light shading portion 417 corresponding to the light source module 30. In at least one embodiment, the light shading portion 417 is integrated with the bottom wall 412 and the periphery wall 413. That is, the light shading portion 417 is also made of transparent or translucent material. In at least one embodiment, the light guide member 41 includes two light shading portions 417. Each light shading portion 417 is substantially U-shaped and is perpendicularly extended from an exterior of the periphery wall 413. An outside surface of the light shading portion 417 forms a reflective layer 418. The reflective layer 418 is formed via coating or pasting a reflective material on the outside surface of the light shading portion 417. Each light shading portion 417 corresponds to one light guide surface 416 and surrounds one light guide surface 416 therein, then the light from the light source module 30 can enter the light shading portion 417 and is reflected to the periphery wall 413, and is further transported out from the top portion 411, thus the light from the light source module 30 can be guided to the light guiding member 41 as much as possible.

In other embodiments, the light reflective layer 418 can also be formed at an inside surface of the light shading portion 417. Then, the light reflective layer 418 directly reflects the light from the light source module 30 to the interior of the periphery wall 413 and transports the light out from the top portion 411.

Figure 5:
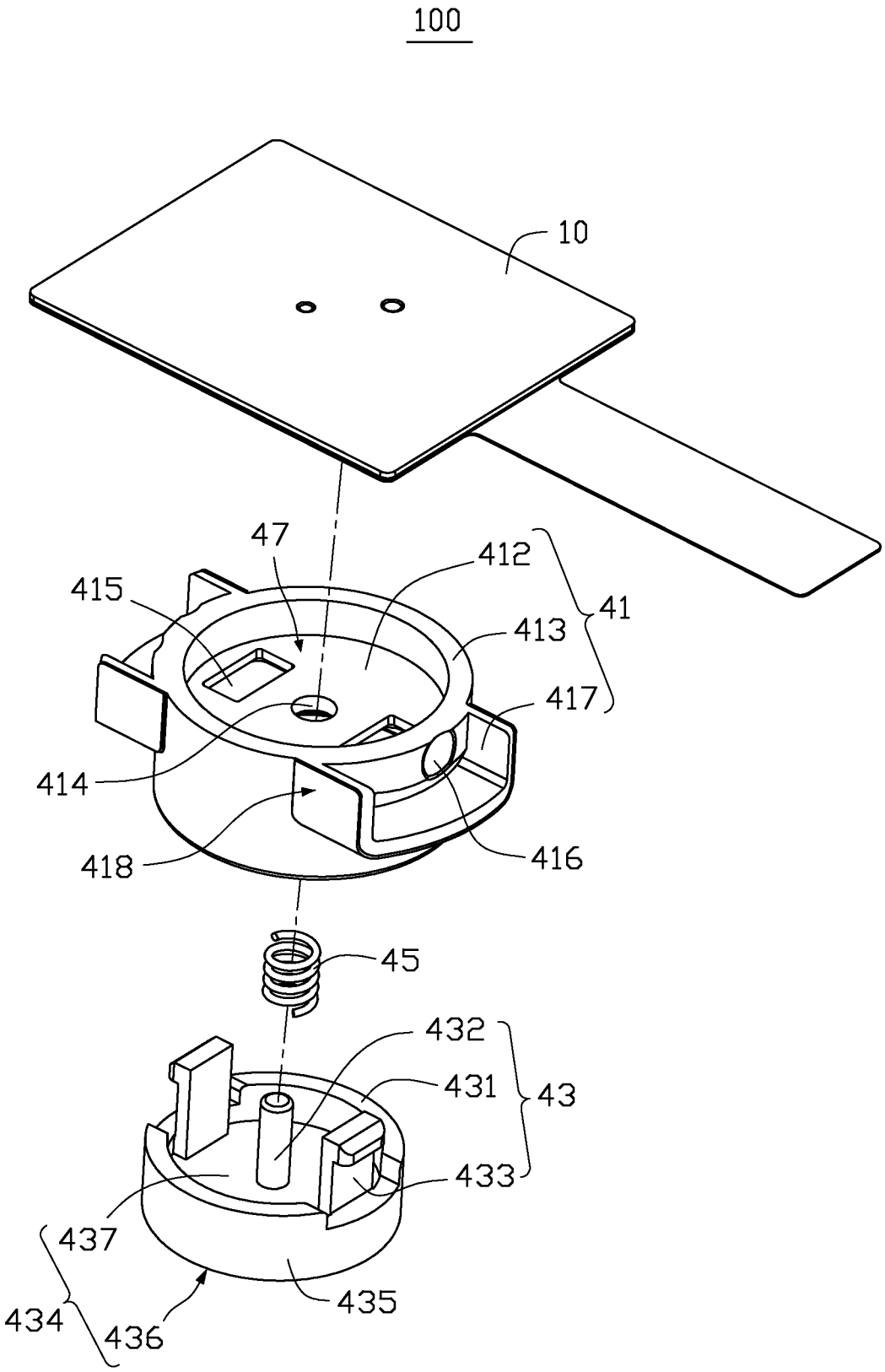
FIG. 5 is similar to FIG. 4, but showing in another angle.

FIG. 5 illustrates that the pressing member 43 includes a pressing portion 431, a resisting portion 432 protruding from the pressing portion 431, and at least one latching portion 433 corresponding to the latching slot 415.

The pressing portion 431 includes a top wall 434 and a side wall 435. The top wall 434 is substantially circular. In other embodiments, the top wall 434 can also be rectangular or other shapes. The side wall 435 is substantially hollow ring-shaped cylinder and surrounds a periphery of the top wall 434. The top wall 434 includes a pressing surface 436 and a matching surface 437 opposite to the pressing surface 436. The pressing surface 436 is surrounded by the top portion 411 and exposed from the housing 60 with the top portion 411.

The resisting portion 432 is substantially a cylinder and is protruded from the middle of the matching surface 437. The resisting portion 432 corresponds to the through hole 414. The resisting portion 432 passes through the through hole 414 and is aligned with the switch module 20. In at least one embodiment, the pressing member 43 includes two latching portions 433 and each latching portion 433 is a hook. The two latching portions 433 are positioned at two sides of the resisting portion 432 and are spaced apart with each other. Each latching portion 433 corresponds to one latching slot 415.

The elastic member 45 is a spring and is sleeved on the resisting portion 432. The elastic member 45 is resisted between the matching surface 437 of the pressing member 43 and the bottom wall 412 of the light guiding member 41 and is configured to provide elasticity for driving the pressing member 43 to move relative to the light guide member 41.

Figure 6:
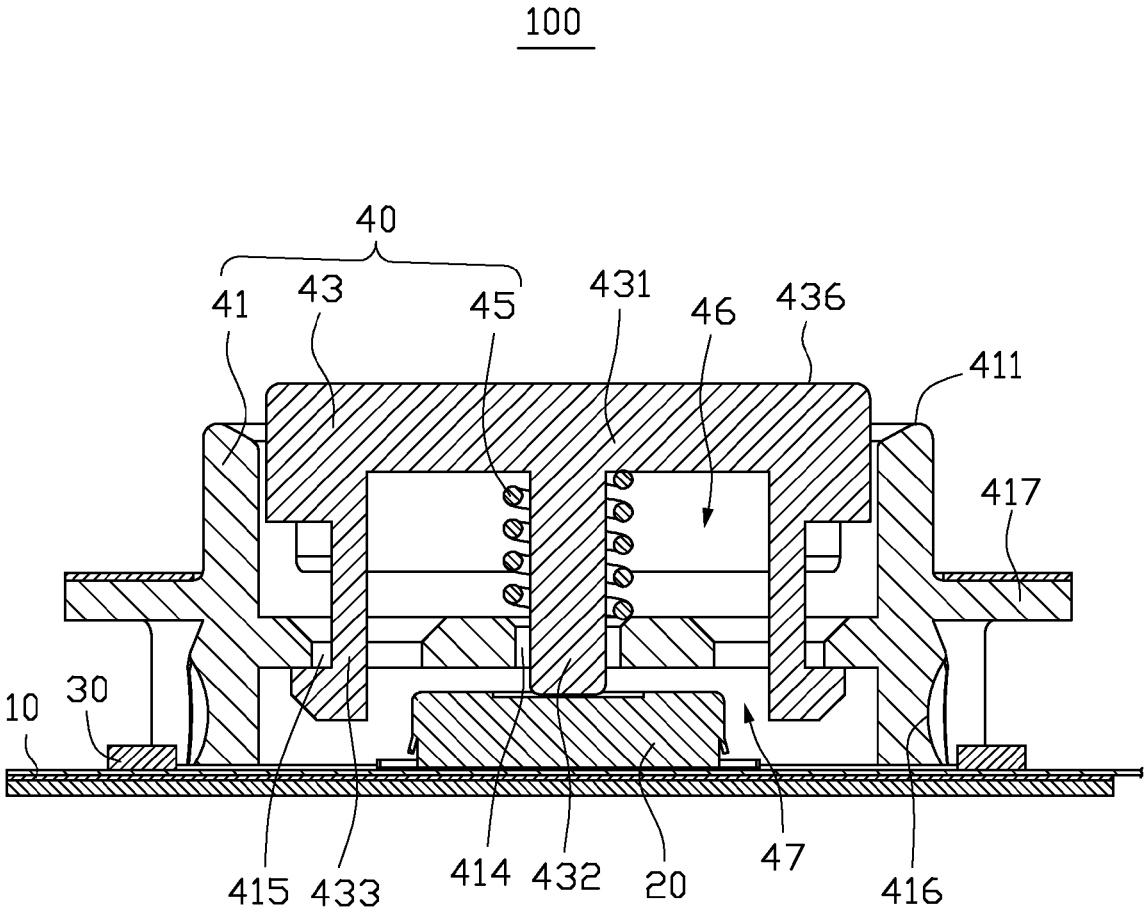
FIG. 6 is a cross-sectional view taken along line VI-VI of FIG. 3.

FIG. 6 illustrates that when assembling the electronic device, the switch module 20 and the light source module 30 are secured on the circuit board 10. The pressing member 43 and the elastic member 45 are assembled to the light guide member 41. In detail, the elastic member 45 is sleeved on the resisting portion 432 with one end resisting the matching surface 437 of the pressing member 43 and the other end resisting the bottom wall 412 of the light guiding member 41. The pressing portion 431 is received in the first receiving cavity 46 of the light guide member 41. The resisting portion 432 is aligned with the through hole 414. The resisting portion 432 passes through the through hole 414 and faces the switch module 20. Each latching portion 433 passes through one latching slot 415 and engages with one latching slot 415. Then, the button body 40 is assembled. The button body 40 is secured to the circuit board 10 with the switch module 20 received in the second receiving cavity 47 of the light guide member 41 and the resisting portion 432 is aligned with the switch module 20. The button body 40 can be mounted to the circuit board 10 through glue or the like. In at least one embodiment, the light source module 30 is positioned at outside of the light guide member 41, faces the light guide surface 416, and is positioned below the light shading portion 417.

When used, pressing the pressing surface 436 toward the circuit board 10. Thus, the elastic member 45 is deformed. The pressing member 43 moves toward the switch module 20 until a distal end of the resisting portion 432 resists against the switch module 20. The switch module 20 is activated and controls the light source module 30 to irradiate light. The light from the light source module 30 is guided to the light guiding member 41 through the light guiding surface 416, and is transported to the top portion 411 along the periphery wall 413. Then, the periphery of the pressing member 43 is evenly lighted up.

Figure 7:
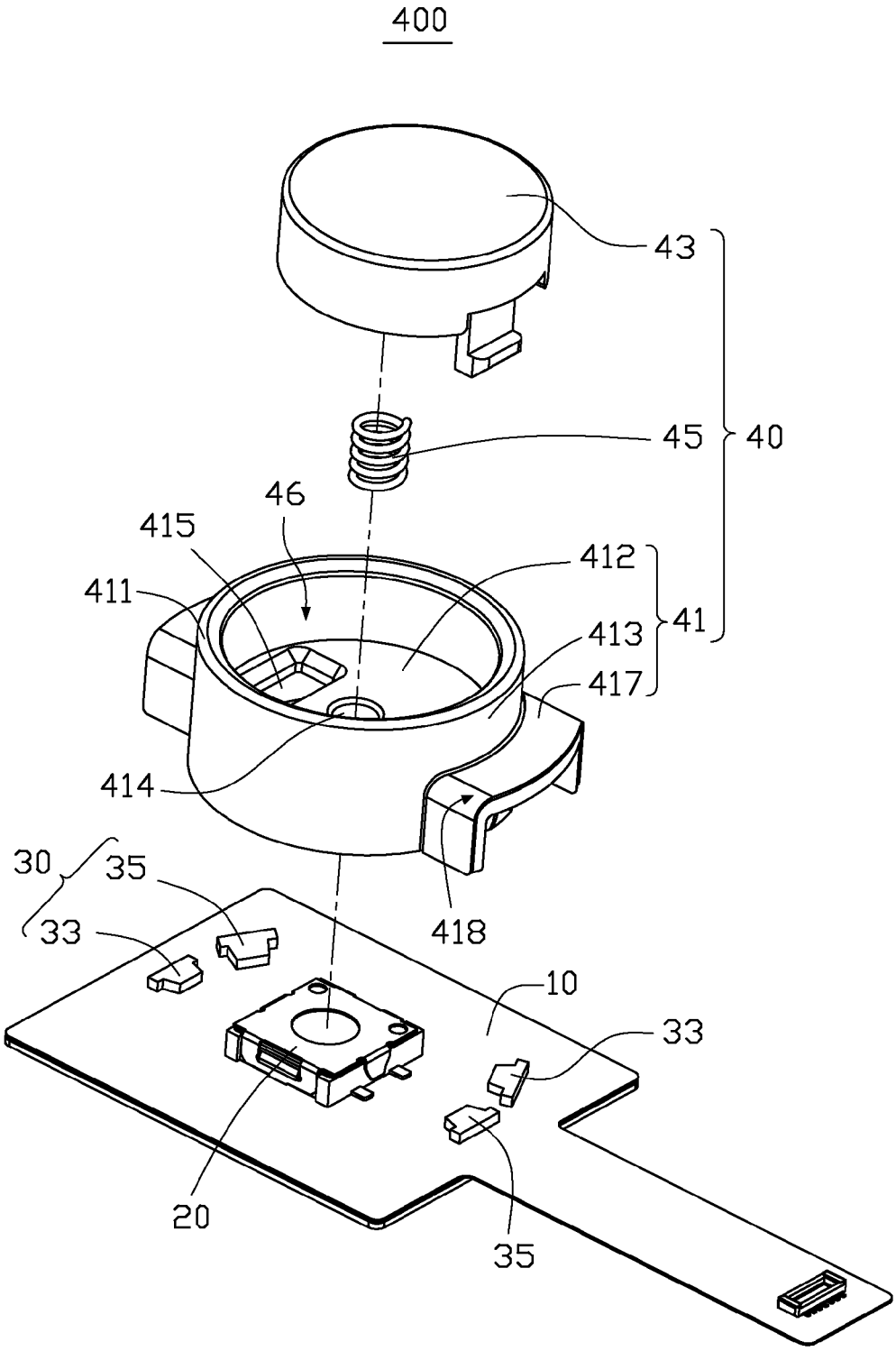
FIG. 7 is an exploded, isometric view of a second embodiment of a button structure.

FIG. 7 illustrates a second embodiment of a button structure 400. The button structure 400 differs from the button structure 100 in that the light source module 30 includes two groups of light-emitting units, that is, a first group of light-emitting units 33 and a second group of light-emitting units 35. The first group of light-emitting units 33 and the second group of light-emitting units 35 are configured to generate different colors. In at least one embodiment, the first group of light-emitting units 33 includes two white LEDs. The two white LEDs are positioned at two sides of the switch module 20. The second group of light-emitting units 35 includes two red LEDs. The two red LEDs are also positioned at two sides of the switch module 20 and are respectively positioned adjacent to one white LED. In addition, the two white LEDs and the two red LEDs can be positioned alternately at two sides of the switch module 20, then the light irradiated by the two white LEDs and the two red LEDs can be evenly transported to the periphery wall 413, and thereby being emitted out from the top portion 411.

In other embodiments, the number of the groups of light-emitting units, the number of the LEDs in each group of light-emitting units, the colors of the LEDs, and the arrangement of the LEDs can be adjusted according to a need of a user.

In other embodiments, the switch module 20 can include a first pressing state and a second pressing state according to a pressing degree of the switch module 20. For example, when the switch module 20 is pressed by the pressing member 43 to be in the first pressing state, the switch module 20 controls the first group of light-emitting units 33 to irradiate white light. When the switch module 20 is pressed by the pressing member 43 to be the second pressing state, the switch module 30 controls the second group of light-emitting units 35 to irradiate red light. Then, the light source module 20 can indicate different functions of the electronic device. For example, when the user needs to control the electronic device to capture images, the user can operate the pressing member 43 to control the switch module 20 to be in the first pressing state, the first group of light-emitting units 33 irradiates white light, which indicates that the electronic device is focusing. When the user continues to operate the pressing member 43 to control the switch module 30 to be in the second pressing state, the second group of light-emitting units 35 irradiates red light, which indicates that the electronic device is taking photograph. Thus, the user can determine the functions of the electronic device according to the color of the light guide member 41.

It can be understood that when the second group of light-emitting units 35 irradiates light, the first group of light-emitting units 33 can be turned off or irradiates light.

It can be understood that when the switch module 20 is activated by the pressing member 43 to be in the first pressing state, the switch module 20 controls the first group of light-emitting units 33 to irradiate sparkling white light, which indicates that the electronic device is focusing. When the switch module 20 is pressed by the pressing member 43 to be the second pressing state, the switch module 30 controls the second group of light-emitting units 35 to irradiate sparkling red light, which indicates that the electronic device is taking photograph. Thus, the user can determine the functions of the electronic device according to the color or the light state of the light guide member 41.

Figure 8:
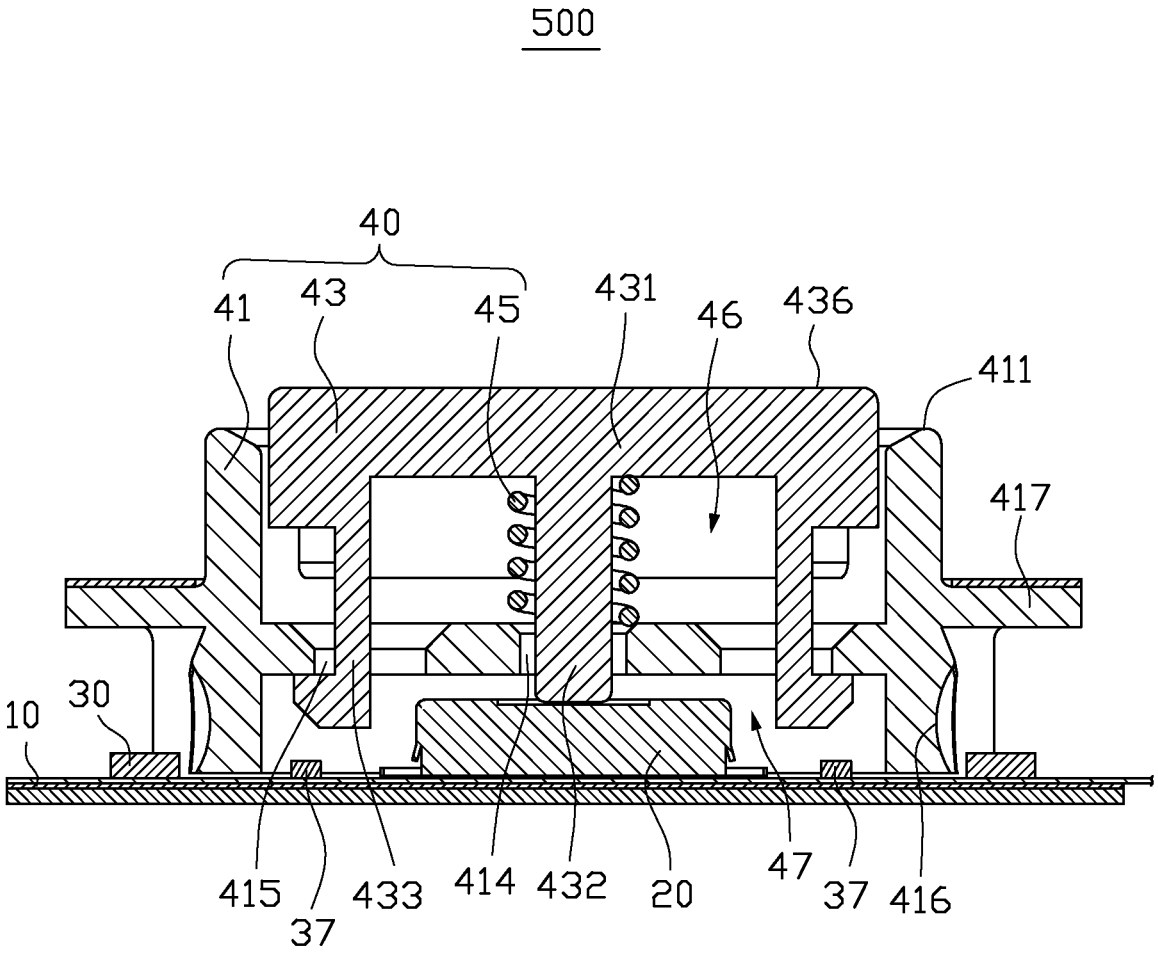
FIG. 8 is a cross-sectional view of a third embodiment of a button structure.

FIG. 8 illustrates a third embodiment of a button structure 500. The button structure 500 differs from the button structure 400 in that the light source module 30 further includes a third group of light-emitting units 37. The pressing member 43 can be made of transparent or translucent material. The third group of light-emitting units 37 is secured on the circuit board 10 and is received in the second receiving cavity 47. When the third group of light-emitting units 37 irradiates light, the light enters into the light guide member 41 and is transported to the top portion 411 and the pressing surface 436 along the periphery wall 413. In at least one embodiment, the third group of light-emitting units 37 includes two green LEDs, the two green LEDs are positioned at two sides of the switch module 20.

In other embodiments, the number of the LEDs in the third group of light-emitting units 37, the colors of the LEDs in the third group of light-emitting units 37, and the arrangement of the LEDs in the third group of light-emitting units 37 can also be adjusted according to a need of the user.

It can be understood that when the first and second groups of light-emitting units 33, 35 irradiate light, the third group of light-emitting units 37 can also irradiate light, which makes the button structure 100 appear in multiple colors to enhance the utility of the electronic device.

In other embodiments, the elastic member 45 can be omitted and the resisting portion 432 can be made of an elastic material, such as, rubber, foam, or the like.

The embodiments shown and described above are only examples. Many details are often found in the art such as the other features of the antenna module and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A button structure comprising:

a circuit board;

a switch module positioned on the circuit board;

a light source module positioned on the circuit board; and a button body positioned on the circuit board and comprising:

a light guide member comprising a bottom wall, a periphery wall having at least one light guide surface, and at least one light shading portion corresponding to the at least one light guide surface, wherein the periphery wall and the bottom wall cooperatively form at least one receiving cavity, and wherein the at least one light shading portion extends from an outside surface of the periphery wall and each light shading portion surrounds one light guide surface; and a pressing member movably mounted in the receiving cavity of the light guide member and facing the switch module;

wherein when the pressing member is pressed, the pressing member activates the switch module and the switch module is activated to control the light source module to irradiate light, so that the light from the light source module enters the light guide member through the one light guide surface and is emitted out from a top portion of the periphery wall.

2. The button structure of claim 1, wherein the light guide surface is a concave surface or an arc surface.

3. The button structure of claim 2, wherein each light shading portion comprises a reflective layer formed on one of an outside surface and an inside surface of the light shading portion.

4. The button structure of claim 1, wherein the light source module comprises a first group of light-emitting units and a second group of light-emitting units, the switch module comprises a first pressing state and a second pressing state, when the switch module is activated by the pressing member to be in the first pressing state, the switch module controls the first group of light-emitting units to irradiate light; when the switch module is activated by the pressing member to be in the second pressing state, the switch module controls the second group of light-emitting units to irradiate light.

5. The button structure of claim 1, wherein the pressing member comprises a pressing surface, the top portion surrounds the pressing surface.

6. The button structure of claim 1, wherein the button body further comprises an elastic member, the elastic member is resisted between the light guide member and the pressing member.

7. The button structure of claim 1, wherein the pressing member comprises a pressing portion and a resisting portion protruding from the pressing portion, the bottom wall defines a through hole, the resisting portion passes through the through hole and is aligned with the switch module.

8. The button structure of claim 7, wherein the pressing member further comprises at least one latching portion protruding from the pressing portion, the bottom wall further defines at least one latching slot, each latching portion passes through one latching slot and engages with the latching slot.

9. The button structure of claim 4, wherein the first group of light-emitting units and the second group of light-emitting units are positioned outside of the light guide member.

10. The button structure of claim 9, wherein the light source module further comprises a third group of light-emitting units, the third group of light-emitting units is secured on the circuit board and is positioned inside of the light guide member.

11. An electronic device comprising:

a housing; and a button structure positioned in the housing and comprising:

a circuit board;

a switch module positioned on the circuit board;

a light source module positioned on the circuit board; and a button body positioned on the circuit board and comprising:

a light guide member comprising a bottom wall, a periphery wall having at least one light guide surface, and at least one light shading portion corresponding to the at least one light guide surface, wherein the periphery wall and the bottom wall cooperatively form at least one receiving cavity, and wherein the at least one light shading portion extends from an outside surface of the periphery wall and each light shading portion surrounds one light guide surface; and a pressing member movably mounted in the receiving cavity of the light guide member and facing the switch module;

wherein when the pressing member is pressed, the pressing member activates the switch module and the switch module is activated to control the light source module to irradiate light, so that the light from the light source module enters the light guide member through the one light guide surface and is emitted out from a top portion of the periphery wall.

12. The electronic device of claim 11, wherein the light guide surface is a concave surface or an arc surface.

13. The electronic device of claim 12, wherein each light shading portion comprises a reflective layer formed on one of an outside surface and an inside surface of the light shading portion.

14. The electronic device of claim 11, wherein the light source module comprises a first group of light-emitting units and a second group of light-emitting units, the switch module comprises a first pressing state and a second pressing state, when the switch module is activated by the pressing member to be in the first pressing state, the switch module controls the first group of light-emitting units to irradiate light; when the switch module is activated by the pressing member to be in the second pressing state, the switch module controls the second group of light-emitting units to irradiate light.

15. The electronic device of claim 11, wherein the pressing member comprises a pressing surface, the top portion surrounds the pressing surface.

16. The electronic device of claim 11, wherein the button body further comprises an elastic member, the elastic member is resisted between the light guide member and the pressing member.

17. The electronic device of claim 11, wherein the pressing member comprises a pressing portion and a resisting portion protruding from the pressing portion, the bottom wall defines a through hole, the resisting portion passes through the through hole and is aligned with the switch module.

18. The electronic device of claim 17, wherein the pressing member further comprises at least one latching portion protruding from the pressing portion, the bottom wall further defines at least one latching slot, each latching portion passes through one latching slot and engages with the latching slot.

19. The electronic device of claim 14, wherein the first group of light-emitting units and the second group of light-emitting units are positioned outside of the light guide member.

20. The electronic device of claim 19, wherein the light source module further comprises a third group of light-emitting units, the third group of light-emitting units is secured on the circuit board and is positioned inside of the light guide member.

21. An electronic device comprising:

a housing; and a button structure positioned in the housing and comprising:

a circuit board;

a switch module positioned on the circuit board;

a light source module positioned on the circuit board; and a button body positioned on the circuit board and comprising:

a light guide member comprising a bottom wall and a periphery wall having at least one light guide surface, wherein the periphery wall and the bottom wall cooperatively form at least one receiving cavity; and a pressing member movably mounted in the receiving cavity of the light guide member and facing the switch module;

wherein when the pressing member is pressed, the pressing member activates the switch module and the switch module is activated to control the light source module to irradiate light, so that the light from the light source module enters the light guide member through the one light guide surface and is emitted out from a top portion of the periphery wall; and wherein the pressing member comprises a pressing portion and a resisting portion protruding from the pressing portion, the bottom wall defines a through hole, the resisting portion passes through the through hole and is aligned with the switch module.

22. The electronic device of claim 21, wherein the pressing member further comprises at least one latching portion protruding from the pressing portion, the bottom wall further defines at least one latching slot, each latching portion passes through one latching slot and engages with the latching slot.

* * * * *